US011426674B2

(12) United States Patent
Mowbray

(10) Patent No.: US 11,426,674 B2
(45) Date of Patent: Aug. 30, 2022

(54) NOVELTY BREAKABLE SHELL

(71) Applicant: ZURU (SINGAPORE) PTE. LTD., Central (SG)

(72) Inventor: Mathew Peter Mowbray, Cambridge (NZ)

(73) Assignee: ZURU (Singapore) Pte. Ltd.

( * ) Notice: Subject to any disclaimer, the term of this patent is extended or adjusted under 35 U.S.C. 154(b) by 0 days.

(21) Appl. No.: 16/765,442

(22) PCT Filed: Feb. 16, 2018

(86) PCT No.: PCT/IB2018/050950
§ 371 (c)(1),
(2) Date: May 19, 2020

(87) PCT Pub. No.: WO2019/097308
PCT Pub. Date: May 23, 2019

(65) Prior Publication Data

US 2020/0330892 A1 Oct. 22, 2020

Related U.S. Application Data

(63) Continuation-in-part of application No. 29/626,773, filed on Nov. 20, 2017, now Pat. No. Des. 839,368.

(60) Provisional application No. 62/615,591, filed on Jan. 10, 2018.

(51) Int. Cl.

| | |
|---|---|
| ***A63H 33/00*** | (2006.01) |
| ***A63F 9/12*** | (2006.01) |
| ***A63F 9/00*** | (2006.01) |
| ***B65D 8/00*** | (2006.01) |

(52) U.S. Cl.
CPC ..... *A63H 33/003* (2013.01); *A63F 9/12* (2013.01); *A63F 2009/0012* (2013.01); *A63F 2009/124* (2013.01); *B65D 11/02* (2013.01)

(58) Field of Classification Search
CPC ..... A63H 33/003; A63H 37/00; A63F 9/12; A63F 2009/0012; A63F 2009/124; B65D 11/02
USPC ..... 446/4, 5, 73, 376
See application file for complete search history.

(56) References Cited

U.S. PATENT DOCUMENTS

| | | | | | |
|---|---|---|---|---|---|
| 294,575 | A * | 3/1884 | Britton | A23G 3/545 | 426/104 |
| 1,546,024 | A * | 7/1925 | Reichenbach | A63F 9/12 | 273/160 |
| 2,996,833 | A | 8/1961 | Giuliano | | |
| 2,998,896 | A * | 9/1961 | Miller | B65D 11/02 | 220/4.26 |
| 3,005,284 | A * | 10/1961 | Giuliano | A63H 37/00 | 446/5 |
| 3,012,367 | A * | 12/1961 | Neumann | A63H 3/16 | 446/4 |

(Continued)

FOREIGN PATENT DOCUMENTS

| | | |
|---|---|---|
| JP | 07-222878 A | 8/1995 |
| JP | 2003-236228 A | 8/2003 |

*Primary Examiner* — Joseph B Baldori
(74) *Attorney, Agent, or Firm* — Dentons US LLP

(57) ABSTRACT

A breakable shell defining an enclosure within which a toy is contained. The breakable shell has a plurality of plastic shell pieces able to self-retain together to define the enclosure. The shell, when dropped from a sufficient height on a solid surface will break apart by the shell pieces all disconnecting from each other thereby revealing the toy.

22 Claims, 11 Drawing Sheets

(56) References Cited

Figure 1A:
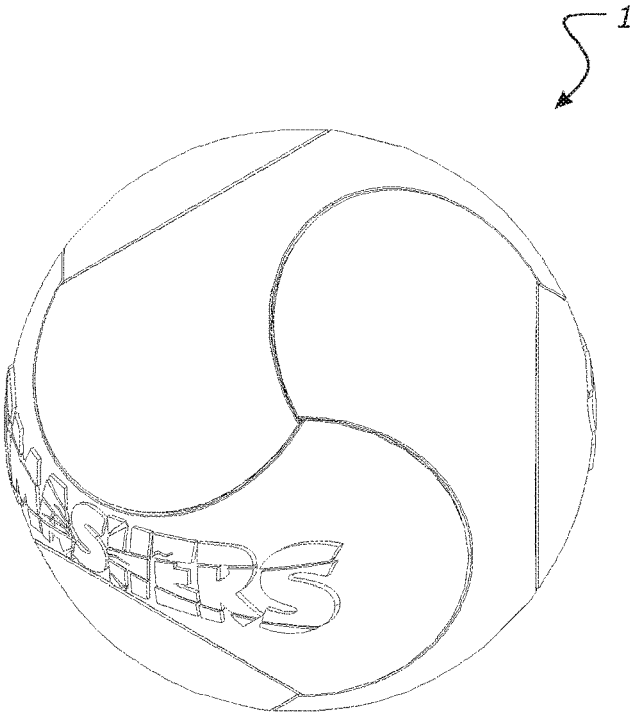

U.S. PATENT DOCUMENTS 3,139,697 A * 7/1964 Mier ..... F42B 8/26 446/4
3,687,452 A * 8/1972 Thompson ..... A63B 43/00 473/577
3,691,704 A * 9/1972 Novak ..... B65D 88/04 52/81.4
4,212,460 A 7/1980 Kraft
4,736,943 A * 4/1988 Fukuda ..... A63H 13/02 446/310
4,765,501 A * 8/1988 Kao ..... B65D 11/02 220/4.21
4,886,273 A 12/1989 Unger
D393,020 S 3/1998 Arcos
5,792,496 A * 8/1998 Fekete ..... A23G 3/50 220/4.21
5,813,895 A * 9/1998 Cho ..... A63H 3/00 446/153
6,050,438 A * 4/2000 Kovens ..... B65D 11/02 220/4.24
6,086,449 A * 7/2000 Sharp ..... A63H 33/103 446/308
6,250,985 B1 * 6/2001 Nicholson ..... A63H 37/00 446/368
D482,418 S * 11/2003 Estefano ..... D21/713
7,523,938 B2 * 4/2009 Chuang ..... A63F 9/12 273/157 R
7,547,019 B2 * 6/2009 Chen ..... A63F 9/0826 273/153 S
7,992,737 B2 8/2011 Salice
10,562,663 B2 * 2/2020 Mowbray ..... B65D 5/009
2005/0248090 A1 * 11/2005 Anders ..... A63F 9/0865 273/156
2007/0102308 A1 5/2007 Tremblay et al.
2010/0194043 A1 * 8/2010 Pavlovic ..... A63F 9/0873 273/157 R
2012/0094571 A1 * 4/2012 Kovens ..... A63H 37/00 446/73
2015/0210432 A1 * 7/2015 Lam ..... B65D 25/04 206/459.5
2016/0001918 A1 * 1/2016 Orion ..... B65D 11/02 220/4.25
2020/0184852 A1 * 6/2020 Hartloff ..... G09B 27/08

* cited by examiner

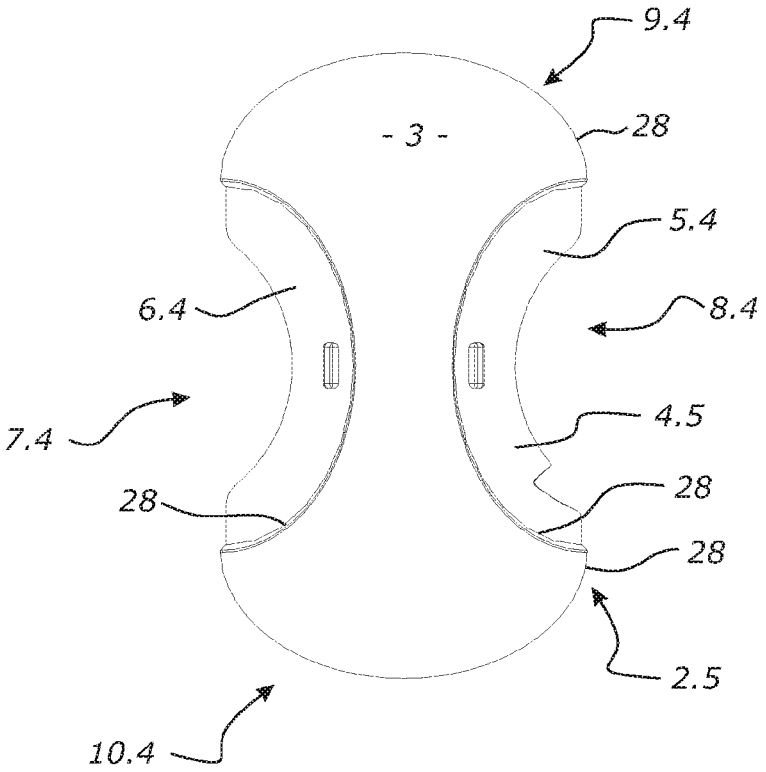
FIGURE 2.1A
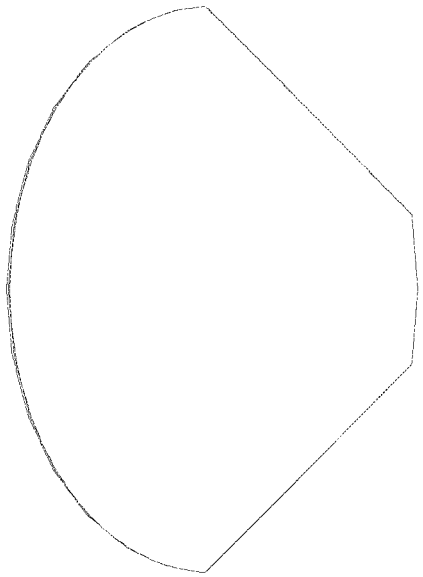
FIGURE 2.1B
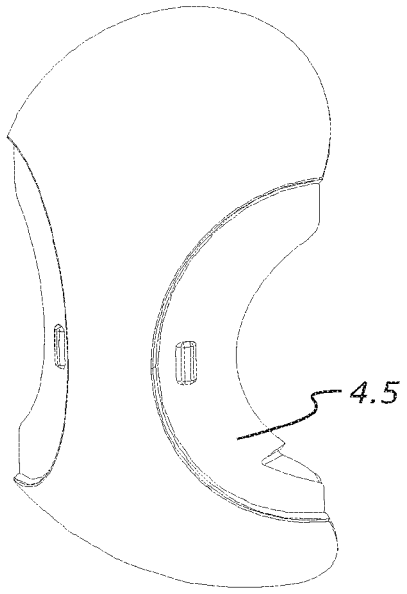
FIGURE 2.1C

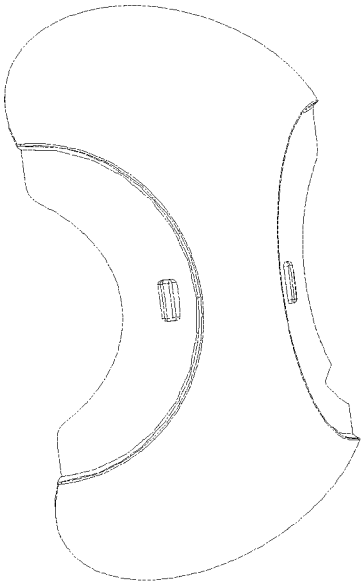
FIGURE 2.1D
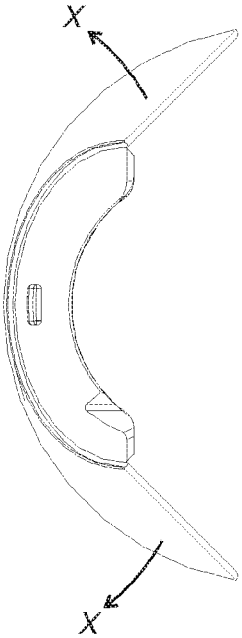
FIGURE 2.1E
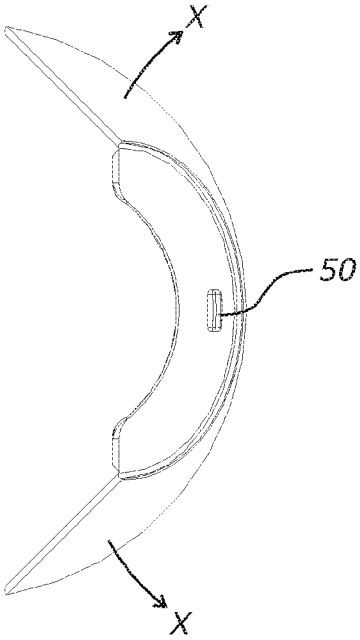
FIGURE 2.1F

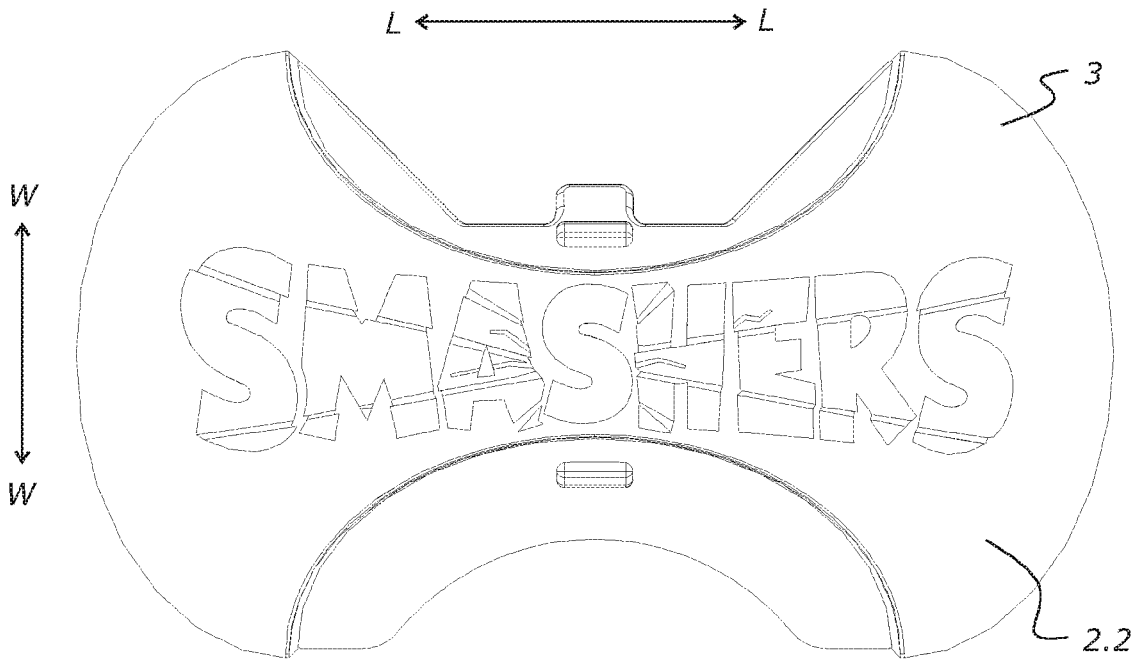
*FIGURE 2.2A*
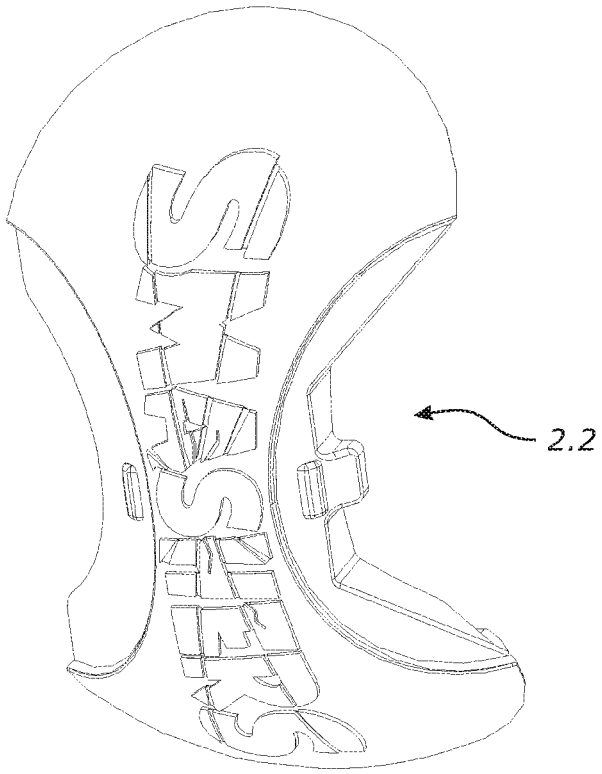
*FIGURE 2.2B*

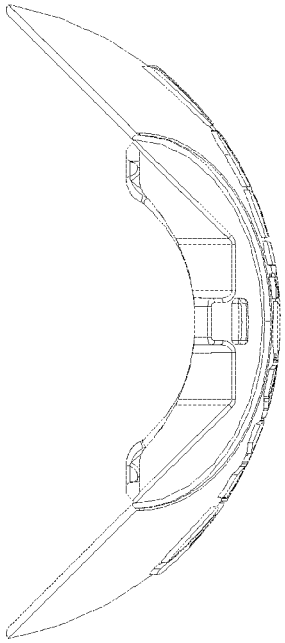
FIGURE 2.2C
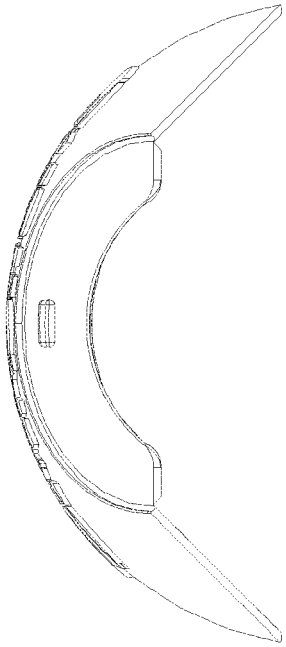
FIGURE 2.2D
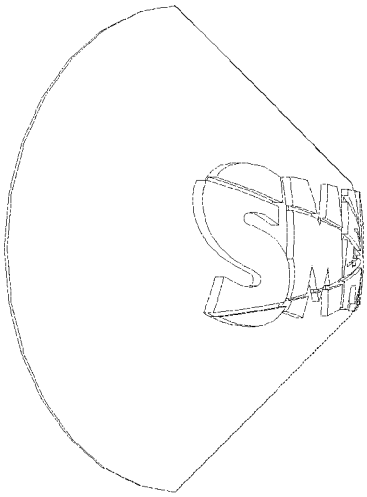
FIGURE 2.2E
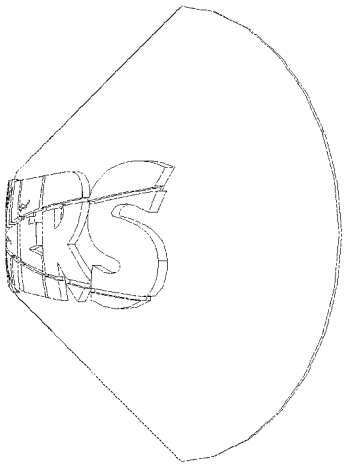
FIGURE 2.2F

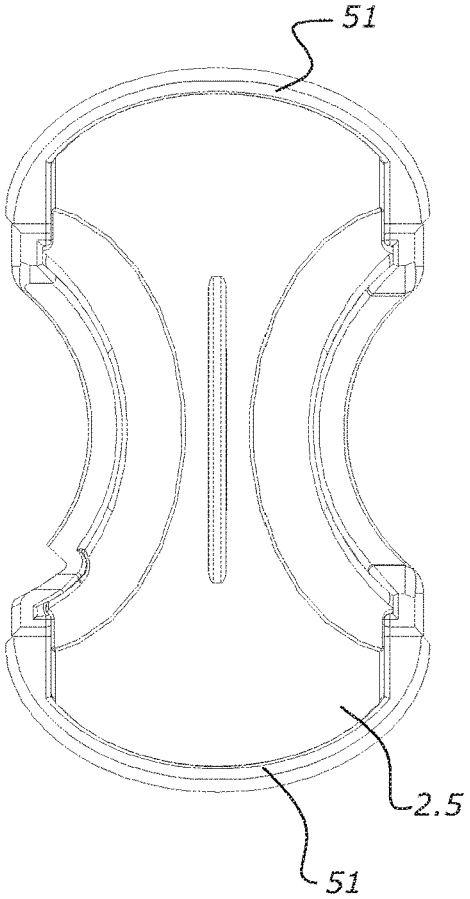
FIGURE 2.1G
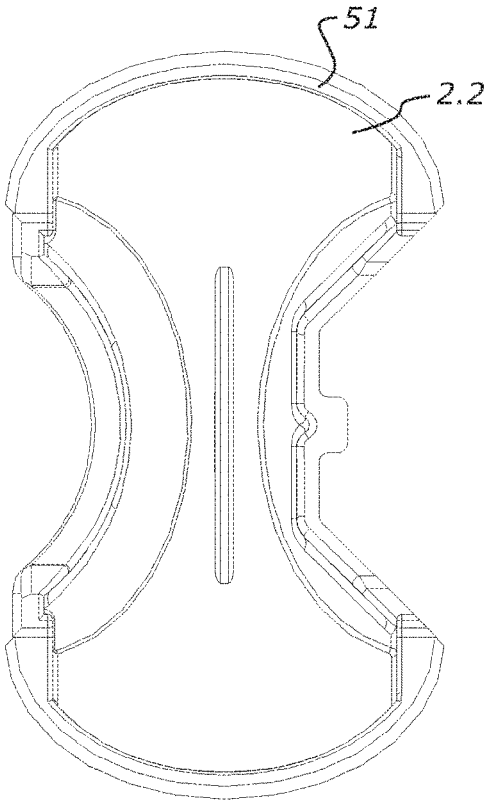
FIGURE 2.2G

NOVELTY BREAKABLE SHELL

This application is a National Stage Application of International Application No. PCT/IB2018/050950, filed on Feb. 16, 2018, which claims the benefit of and priority to U.S. Design Application No. 29/626,773, filed on Nov. 20, 2017, now US Patent No. D839368 and U.S. Provisional Application No. 62/615,591, filed on Jan. 10, 2018, all of which are hereby incorporated by reference in their entirety for all purposes as if fully set forth herein.

The present invention relates to a novelty breakable shell. In particular although not solely the invention is breakable shell comprises of shell pieces to define an enclosure within which a toy or other item may be stored to be revealed upon the breaking of the shell.

It is an object of the present invention to provide a novelty breakable shell that at least provides the public with a useful choice.

Accordingly in a first aspect the present invention can broadly be said to be a breakable shell defining an enclosure within which a toy is contained, the breakable shell comprising of a plurality of plastic shell pieces able to self-retain together to define the enclosure yet when dropped from a sufficient height on a solid surface the shell pieces all disconnect from each other thereby revealing the toy.

Preferably the peripheral shape of the shell is spherical.

Preferably the peripheral shape of the shell is egg-shaped.

Preferably each shell piece is of a weight that is within a 10% range of each other.

Preferably each shell piece is of a weight that is within a 2% range of each other.

Preferably piece is of a weight that is within a 0.5% range of each other.

Preferably the shell pieces are able to self-retain with each other by each shell piece being in both a underlapping condition with an adjacent shell piece and overlapping condition with another adjacent shell piece.

Preferably each shell piece is an underlapping condition with two adjacent shell pieces and an overlapping condition with another two adjacent shell piece.

Preferably each shell piece is in an underlapping condition with two adjacent shell pieces at two opposed peripheral regions of said shell piece and overlapping condition with another two adjacent shell piece at two other opposed peripheral regions of said shell piece.

Preferably each shell piece is resiliently flexible and when the shell is in its assembled condition, each shell piece is in a more flexed state compared to when the shell is in the broken condition.

Preferably the shell pieces are outwardly flexed.

Preferably each shell piece is arcuate and elongate and has two end peripheral regions and two side peripheral regions extending between the two end peripheral regions.

Preferably each end peripheral region of a shell piece is in overlap with a side peripheral region of a respective adjacent shell piece.

Preferably each shell piece comprises of a shell piece body that presents a shell surface, the shell surface of each shell piece defining a part of the peripheral shape of the shell and being identical to the shell surfaces of all the other shell pieces so that when the shell pieces are connected together the shell surfaces are in a tessellated condition.

Preferably the shell piece body substrates the shell surface save for a lip at each of two opposed peripheral regions of the shell piece body that projects beyond the shell surface.

Preferably said lips of each shell piece underlap an adjacent shell piece.

Preferably the shell is made of 6 shell pieces.

Preferably the shell comprises of 6 shell pieces.

Preferably there are 8 tri-points defined by the periphery of shell surfaces of the shell pieces.

Preferably the shell is spherical and wherein each tripoint is of a tripoint pair that are diametrically opposed each other.

Preferably a squeezing of the shell at a pair of tripoints results in a breaking of the shell at a lower pressure than when the shell is squeezed elsewhere.

Preferably when dropped on a solid flat surface from at least 1 metre high above the surface the shell will break apart.

Preferably when dropped on a solid flat surface from less than 20 cm the shell will not break apart.

Preferably the shell is egg-shaped.

Preferably the shell pieces are opaque.

Preferably only 6 disconnected shell pieces result when the shell is broken.

Preferably the toy is loosely retained inside the shell.

Preferably the shell pieces only define the enclosure.

Preferably no adhesive is used to connect the shell pieces to each other.

Preferably the shell is spherical and of a diameter of less than 7 cm.

Preferably the shell is spherical and of a diameter greater than 2.5 cm.

In a second aspect the invention may be said to be a breakable shell defining an enclosure within which an item can be contained, the breakable shell comprising of a plurality of plastic shell pieces able to self-connect together to define the enclosure yet when dropped on a solid surface the shell pieces all disconnect from each other.

In a further aspect the invention may be said to be a toy contained inside an enclosure of a breakable shell comprising of a plurality of plastic shell pieces self-connected together in a releasable manner to define the enclosure, where in when dropped on flat solid surface from at least 1 m high, the shell pieces all separate from each other thereby revealing the toy.

In a further aspect the invention may be said to be breakable shell defining an enclosure within which an item can be contained, the breakable shell comprising of a plurality of plastic shell pieces able to self-connect together in a manner so that each piece is flexed from its natural shape and to define the enclosure that when dropped on a solid surface the shell pieces all disconnect from each other and return to their natural shape.

In a further aspect the invention may be said to be a breakable shell comprising of a plurality of self-retaining shell pieces to define an enclosure containing a surprise item.

In a further aspect the invention may be said to be a shell able to be repeatedly broken into like sized shell pieces, without the shell pieces themselves breaking, and be reassembled to its original unbroken state.

In a further aspect the invention may be said to be a breakable shell comprising of a plurality of resiliently flexible plastic shell pieces able to self-retain together in a flexed state.

Preferably the flexed state is inherently caused by each shell piece being in both an underlapping and overlapping relationship with adjacent shell pieces.

Preferably the flexed state is inherently caused by each shell piece being in an underlapping and overlapping relationship with four adjacent shell pieces.

In a further aspect the present invention may be said to be a method of selling a toy comprising providing a breakable shell as herein defined, within which a toy is housed.

In a further aspect the present invention may be said to be a method of packaging a toy by providing the toy inside of the breakable shell as herein defined.

In a further aspect the present invention may be said to be method of packaging a toy in a breakable shell as herein defined by, prior to the final shell piece being placed to define the shell in its assembled condition, locating a toy to be provided inside the enclosure of the shell once the shell is in its assembled condition.

In a further aspect the present invention may be said to be a toy packaged in a shell as herein defined.

In a further aspect the present invention may be said to be a package containing a toy within a breakable shell as herein defined.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

Figure 1B:
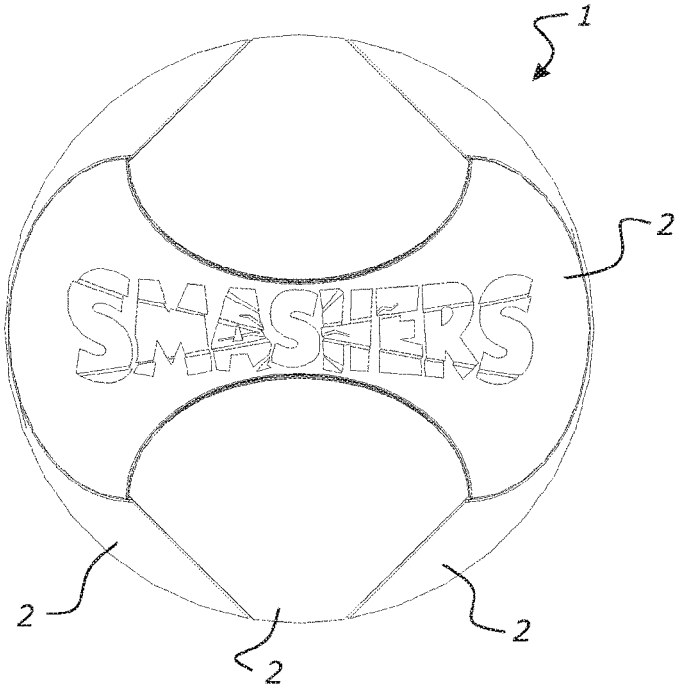
Figure 1C:
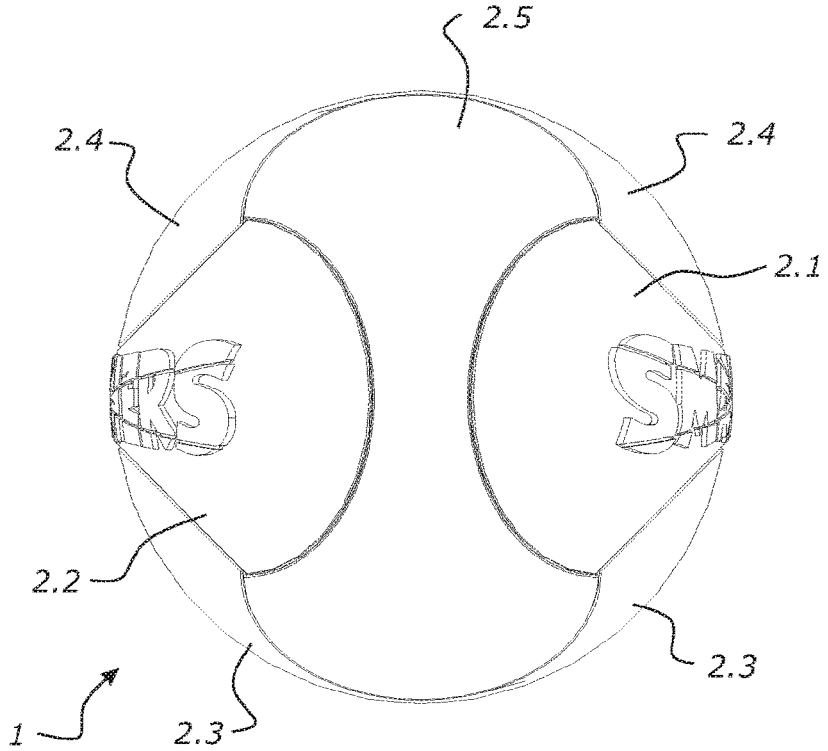
Figure 1D:
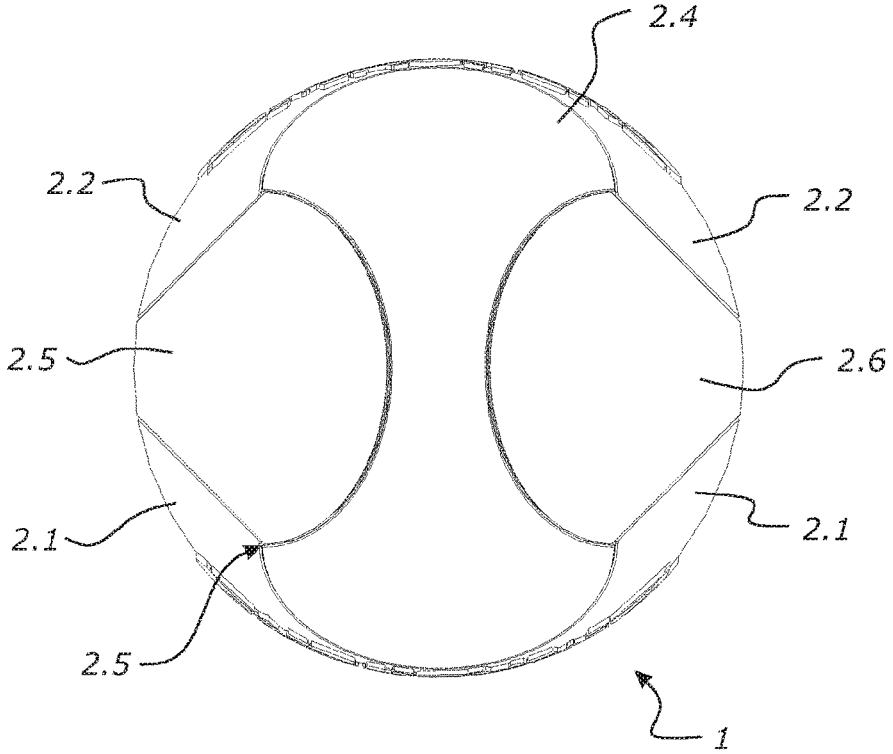

A preferred form of the present invention will now be described with reference to the accompanying drawings in which, FIG. 1*a* is a perspective view of a breakable shell in its assembled condition and shown in the preferred form to be of a spherical perimeter shape, FIG. 1*b*-1*d* show alternative perspectives of the breakable shell of FIG. 1*a*.

FIG. 2.1*a* is a plan view of a shell piece,

FIG. 2.1*b* is an end view of the shell piece of FIG. 2.1*a*,

FIG. 2.1*c* is a perspective view of the shell piece of FIG. 2.1*a*,

FIG. 2.1*d* is another perspective view of the shell piece of FIG. 2.1*a*, FIG. 2.1*e* is a side view of the shell piece of FIG. 2.1*a*

FIG. 2.1*f* is an opposite side view of the shell piece of FIG. 2.1*a*,

FIG. 2.1*g* is a back view of the shell piece of FIG. 2.1*a*,

FIG. 2.2*a* is a front view of another shell piece of a slightly different configuration of the shell piece of FIG. 2.1*a*

FIG. 2.2*b* is a perspective view of the shell piece of FIG. 2.2*a*,

FIG. 2.2*c* is a side view of the shell piece of FIG. 2.2*a*,

FIG. 2.2*d* is an opposite side view of the shell piece of FIG. 2.2*a*,

FIG. 2.2*e* is an end view of the shell piece of FIG. 2.2*a*,

FIG. 2.2*f* is an opposite end view of the shell piece of FIG. 2.2*a*,

FIG. 2.2*g* is a back view of the shell piece of FIG. 2.2*a*.

Figure 3:
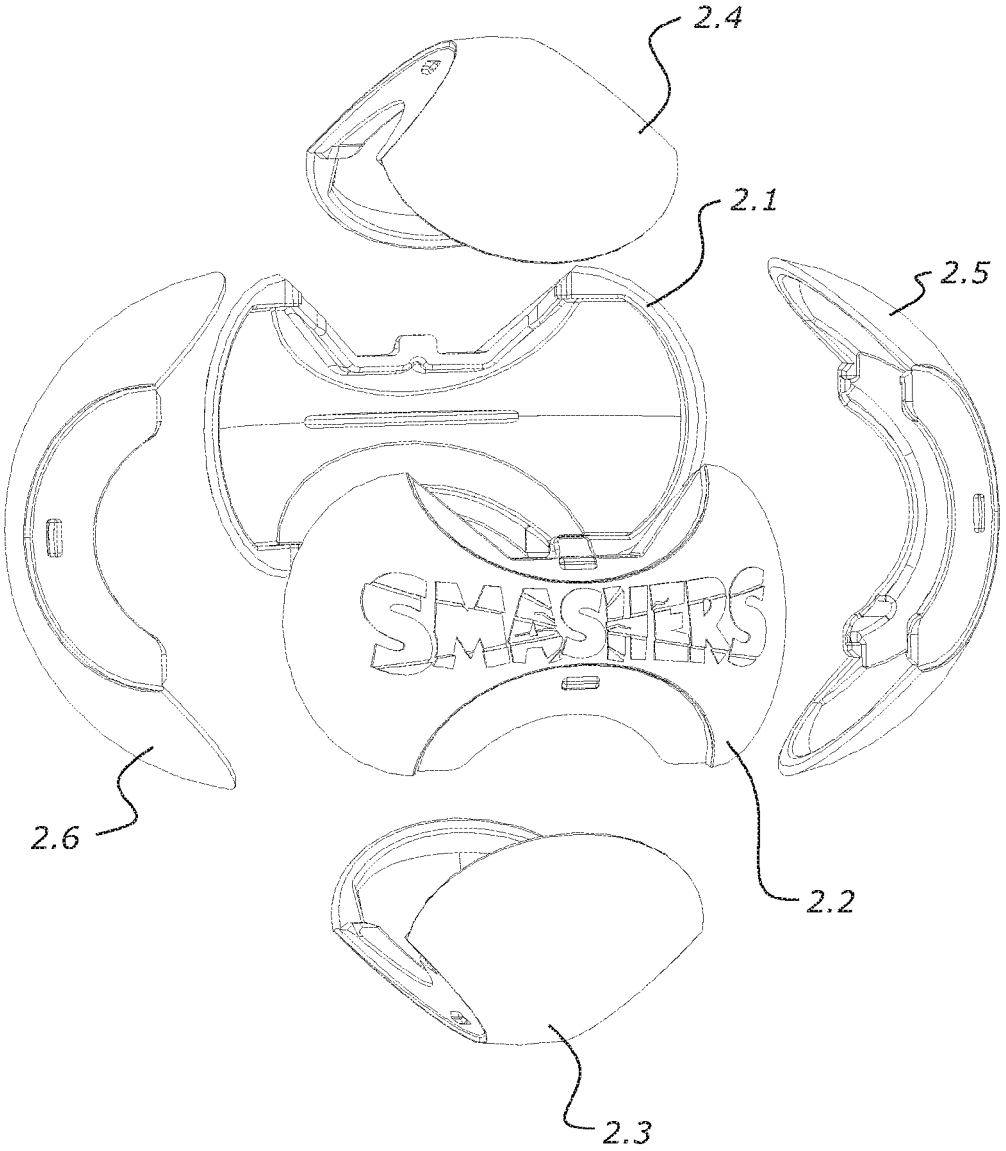
Figure 4:
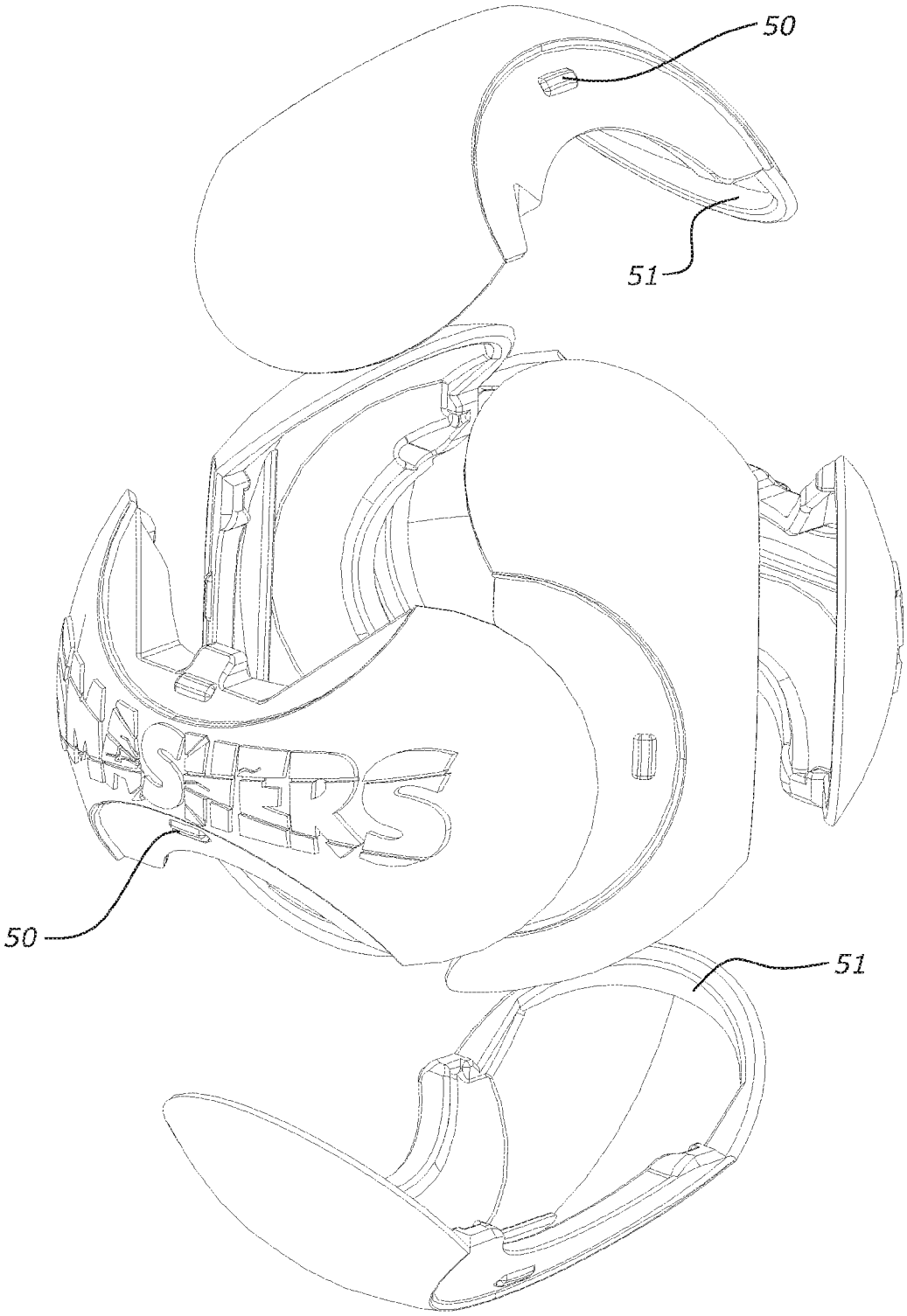
Figure 5:
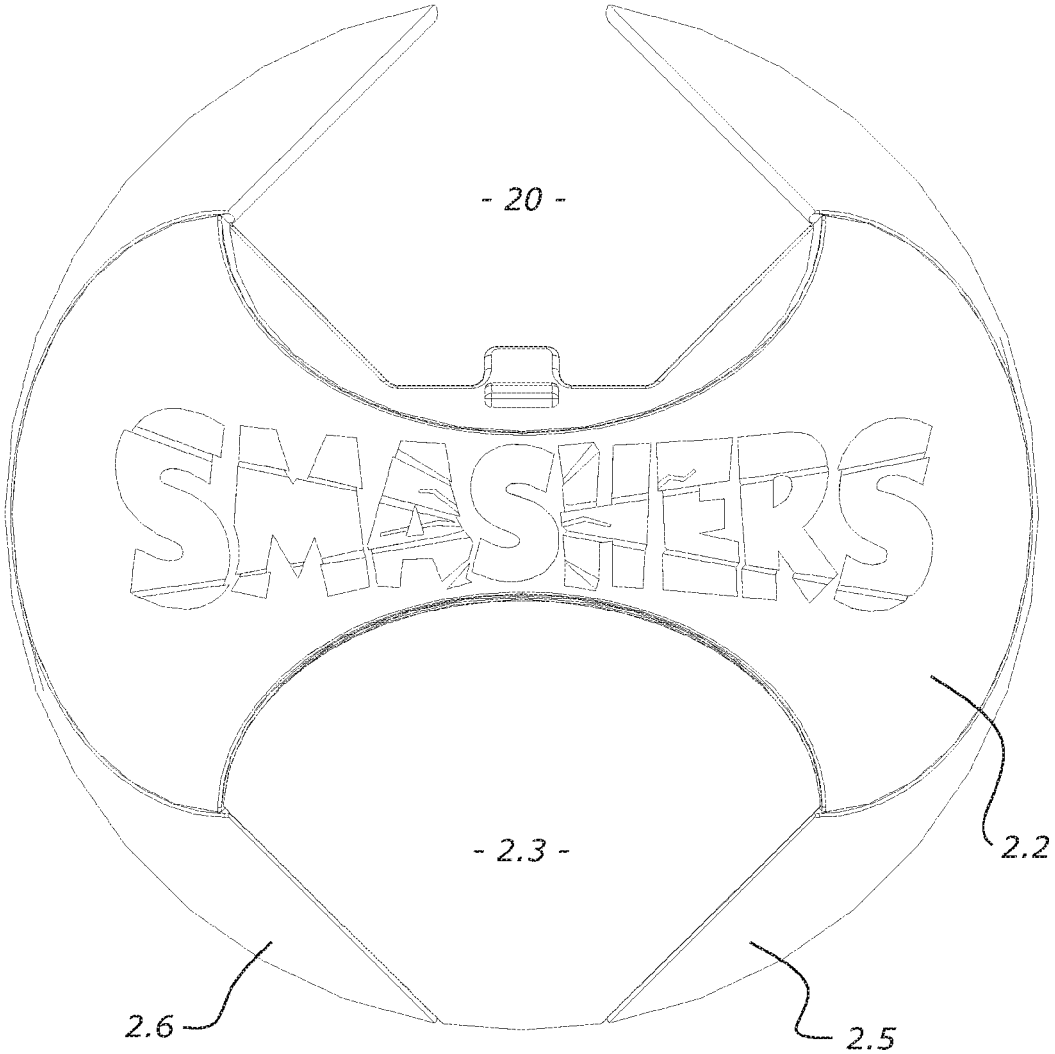
Figure 6:
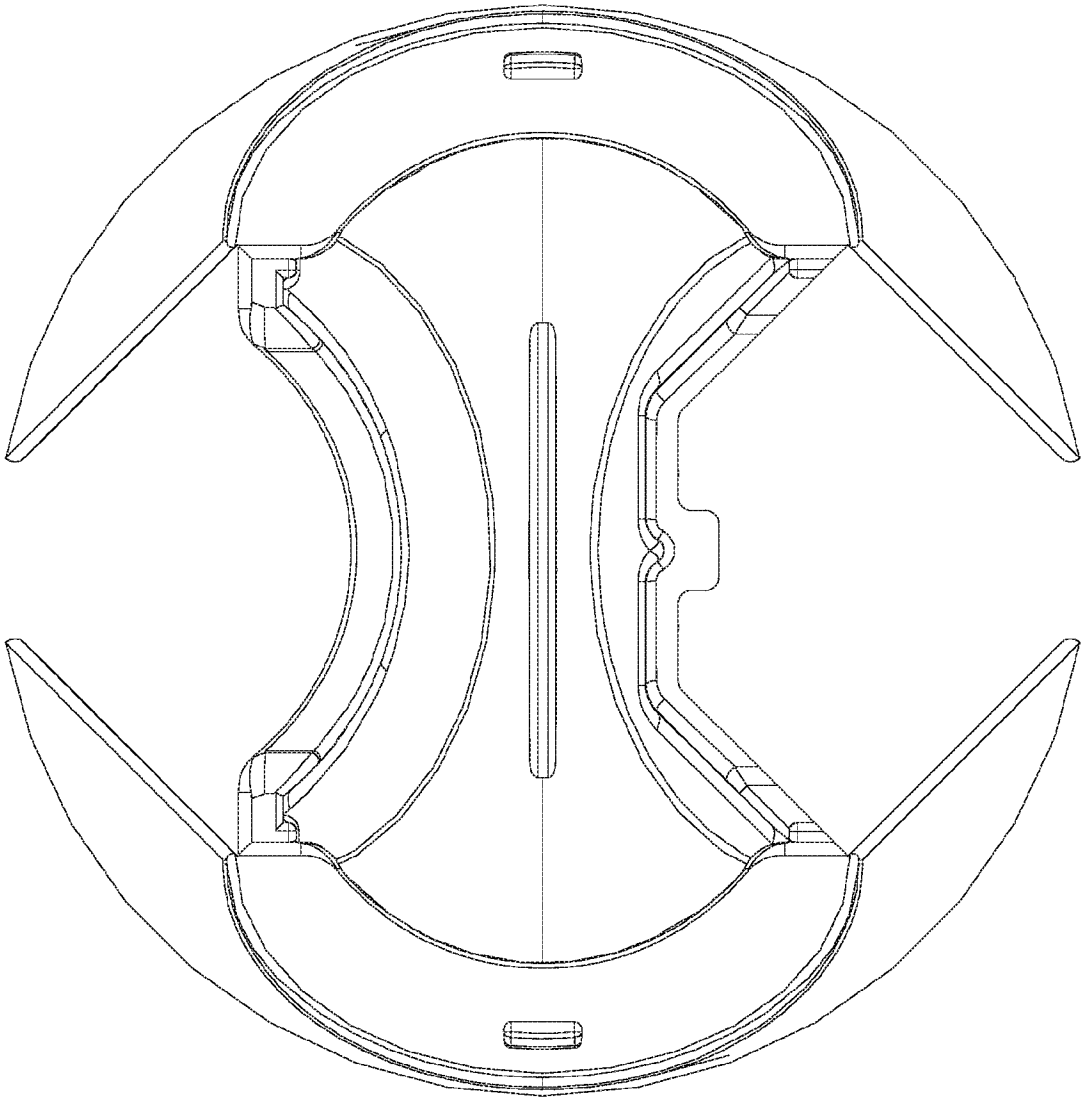

FIG. 3 illustrates an exploded view of the preferred six shell piece breakable shell in an exploded view, FIG. 4 shows an alternative perspective view of the exploded view of FIG. 3, FIG. 5 illustrates a partially assembled breakable shell wherein three shell pieces are positioned together, FIG. 6 is a view of FIG. 5 in the opposite direction.

With reference to FIG. 1 there is shown a breakable shell 1 in its assembled condition. The shell 1 is preferably spherical in perimeter shape. It is preferably of a spherical shape with a diameter preferably between 2.5 and 7 cm. In the preferred form its diameter is 4 cm. It will be appreciated that other shapes are also envisaged within the scope of the invention. Egg shape or rugby ball shape shells are envisaged as examples.

The shell 1 comprises of a plurality of shell pieces 2. For a spherical shell there are preferably the six shell pieces 2.1, 2.2, 2.3, 2.4, 2.5, 2.6 as seen in FIGS. 1*c* and 1*d*. Preferably there are only 6 shell pieces that make up the shell. Each shell piece is substantially of a similar shape although certain features may differ. FIGS. 2.1*a*-*g* show a preferred form of a shell piece that can be used to help create the assembled form of the breakable shell 1. FIGS. 2.2*a*-*g* show a second form of shell piece that may be used with the shell piece form shown in FIGS. 2.1*a*-*g* to create the shell.

The shell pieces are preferably of a similar shape. Each shell piece 2, as for example seen with reference to FIG. 2*a*, comprises of a shell piece exterior surface 3. The shell piece exterior surface 3 is provided by each shell piece 2, when the shell 1 is in its assembled condition, to define a part of the exterior surface of the assembled shell 1. In the preferred form the shell piece exterior surface 3 of a shell piece is identical to the others in boundary perimeter shape 28. The surfaces are also preferably identically curved to correspond to part of the peripheral shape of a spherical version of the shell 1. It will be appreciated that embossing or graphics or colour variations may be provided on each shell piece exterior surface 3 that may differentiate at least one shell piece from the other(s). As can be seen shell piece 2.5 of FIGS. 2.1*a*-*g*, has no surface detailing at exterior surface 3 whereas shell piece 2.2 of FIGS. 2.2*a*-*g* has the words 'smashers' embossed on its exterior surface 3.

The shape of the shell piece exterior surface 3 of each shell piece is such that when the shell pieces to define the breakable shell 1 are assembled together, the exterior surfaces 3 are in a tessellated condition relative to each other. The boundary perimeter shape 28 of each shell piece can hence be located contiguous a part of the boundary perimeter shape of another shell piece. This can be seen with reference to FIGS. 1*a*-*d*. Preferably no holes into the interior of the shell exist. Preferably only the shell pieces herein described go to making up the breakable shell. Adhesive or fasteners are preferably not used.

The shell surface 3 of each shell piece is presented by a shell body such as shell body 4.5 as for example seen in FIGS. 2.1*a*-*f*. The shell body 4.5 effectively provides the substrate carrying or presenting the shell surface 3. Whilst the shell surface 3 of each shell piece is preferably identical, the shell body of each or some of the shell pieces may be different.

In the preferred form there are two configurations of shell pieces. The first configuration is shown in FIGS. 2.1*a*-*g* and the second configuration is shown in FIGS. 2.2*a*-*g*. The configuration of the shell piece shown in FIGS. 2.1*a*-*g* is identical for shell pieces 2.3, 2.4, 2.5 and 2.6 as seen in FIGS. 1*a*-*d*. The shell piece configuration shown in FIGS. 2.2*a*-*g* is identical for shell pieces 2.1 and 2.2 as seen in FIGS. 1*a*-*d*.

The shell body of the shell piece shown in FIGS. 2.1*a*-*f* acts as a substrate to the surface 3 of the shell piece and preferably is coextensive with the surface save preferably for two lips 5.4 and 6.4 that project beyond the boundary 28 of the surface 3. In a preferred form the lips are provided at opposed peripheral regions 7.4 and 8.4 of the shell piece 2.5 and likewise for all the other pieces as seen in the drawings. The two lips sit below the surface 3 of the shell piece and provide a ledge for an adjacent shell piece to contact in an overlying manner. At two other opposed peripheral regions 9.4 and 10.4 the boundary 28 of the surface 3 is coextensive with the underlying (substrate providing) shell piece body 4.5. When assembled the shell piece 2.5 for example has the peripheral region 9.4 overlap a lip of an adjacent shell piece. Likewise the peripheral region 10.4 overlaps a lip of another adjacent shell piece. Similarly the other shell pieces are constructed with adjacent shell pieces to define the assembled shell. This lets adjacent shell pieces be held together in a radial direction relative each other, at these regions.

The over/underlapping construction of shell pieces of an assembled shell results in self-retention of shell pieces to define an assembled shell that is stable yet can be broken. The shell pieces self-retain to provide a stable assembled shell. The configuration of the shell pieces is such that once the last shell piece is assembled with the already connected and appropriately configured shell pieces, it will consolidate the shell pieces to become a stable shell construction self-retaining itself to for example a spherical shape. No adhesive of magnetic force or separate fasteners are required. Without the last shell piece in its assembled position, the breakable shell will not be self-retaining of its final assembled shape.

In the preferred form each shell piece is of a weight that is within a range of 10 percent of each other. So whilst there may be some slight constructional differences in the shell pieces (in the preferred form there are two types of shell pieces to define the preferred six shell pieces in total) the shell pieces are still substantially similar in shape. In the preferred form the weight range is within 2 percent.

The shell once assembled defines an enclosure that is preferably able to retain an item. The item may be a toy for example. It may be some other novelty item or an edible item or fashion item. The shell pieces are preferably opaque. This means that the item is hence preferably a surprise item only revealed to a person when the shell is broken. Breaking of the shell can occur when the shell is dropped onto a surface such as a floor to impact the floor at a sufficient speed to cause the shell pieces to separate from each other.

In the preferred form as already described with reference to numbering annotations on FIG. 2.1*a*, each shell piece is able to be positioned relative to adjacent shell pieces in both an overlapping and underlapping condition. In the preferred form there are two regions where a shell piece is in an underlapping condition, by virtue of its lips 5.4 and 6.4 being located underneath a free edge at regions 9.4 and 10.4 of an adjacent shell piece and in an overlapping condition at the free edges 9.4 and 10.4, overlapping the lips of respective adjacent shell pieces.

Provided at each lip of a piece may be a clipping feature 50 that can interact with a clipping feature 51 at a free edge of another piece. The clipping feature 50 may be an upstand projecting from a lip that can engage with dipping feature 51 in the form of a ledge of the free edge. The upstand and ledge can cooperate with each other to help resist a slipping off of the free edge from the lip by being hooked over the edge in an interference style manner. This can help keep the shell in it assembled condition. The dipping features may be of a configuration to still allow a slipping off to occur under sufficient force being applied.

In the preferred form each shell piece is resiliently flexible. The shell pieces are preferably made from a plastics material. The shell pieces are preferably of an elongate nature as seen in for example in FIG. 2.2*a*. Each shell piece in the elongate direction LL is longer than the width in the width-wise direction WW. In the preferred form the surface 3 is substantially symmetrical about both an elongate direction centreline and a width-wise direction centreline.

Being of a resiliently flexible nature means that the shell piece is able to bend yet return to its natural shape by itself. I.e. it can flex. It preferably bends away from its natural shape in the elongate direction more easily than in its width-wise direction.

The shape and configuration of each of the shell pieces is such that when the shell pieces are assembled together the shell pieces are inherently outwardly bent/flexed. That is, the peripheral regions 9.4 and 10.4 are displaced away from their natural position and apply a force onto the respective lips of adjacent shell pieces. The flexing is in direction XX as shown in FIGS. 2.1*e* and 2.1*f*. The shell pieces are substantially curved in their side profile as seen in FIGS. 2.1*e* and 2.1*f* but when they are in an assembled condition they are less curved. This is by virtue of the shell pieces having been bent slightly out of its natural shape due to the shape and configuration of each shell piece when assembled, forcing the shell pieces to such a flexed condition.

This means that the shell in its assembled condition has each piece in a flexed condition. When the shell is for example dropped on the ground or on a solid surface and hits the surface with sufficient force the shell can break. Breaking results in the shell pieces from springing back to their natural more curved form as they separate from each other. This can cause the shell to break in an explosive like manner as they return to their natural shape. The pieces may hence push each other away or act/react with each other to cause larger separation of the pieces after being dropped and the shell being broken, than may otherwise occur if the pieces were not self-retaining in a flexed manner. The shell pieces may hence not just drop onto the surface on which the shell is dropped but have a tendency to also outwardly or radially spread from each other.

In the preferred form each shell piece is generally arcuate in shape as can for example be seen in FIGS. 2.1*e* and 2.1*f* and FIGS. 2.2*c* and 2.2*d*. As has been mentioned the shell pieces are preferably elongate and in general it can be said that it has two end peripheral regions (e.g. 9.4 and 10.4) and two side peripheral regions (e.g. 7.4 and 8.4) extending between the two end peripheral regions. When the shell pieces are assembled to define the shell 1, a plurality of borders are established between adjacent shell pieces. The borders are at boundaries of the shell piece exterior surfaces. The borders are typically between two shell surfaces and at a plurality of locations tri-points are defined by the boundaries of the shell surfaces of three shell pieces. In the preferred form a tri-point 25 is shown in FIG. 1*d*. The tri-point is where the surfaces of three shell pieces meet. In the preferred form where there are six shell pieces, eight tri-points are established when the shell pieces are assembled together. Each tri-point preferably has a diametrically opposed tri-point.

A squeezing of the shell by applying forces directed towards each other at the two diametrically opposed tri-points will cause a flexing of some of the shell pieces in a manner to more easily cause a separation of the shell pieces from each other than if a squeezing occurred at other locations of the shell. As such when a shell is dropped onto a surface from a height, in some instances the shell may not break apart whereas in other instances the shell, being dropped from the same height may break apart. A dropping of the shell onto a surface may cause, in some instances, a tri-point to make first contact with the surface and therefore is likely to cause disassociation of shell pieces more readily than if the shell is dropped to make contact with another part of the shell with the solid surface. This therefore can create a randomness of the breaking apart of the shell. This can be entertaining for a user who drops a shell onto a surface and who may be expecting the shell to break apart (or vice versa) and this does not happen.

The shell pieces can be assembled and reassembled (after breaking apart) together by overlaying a lip of a first shell piece with a free edge such as edge 9.4 or 10.4 of an adjacent shell. The last piece (piece 2.4) can be assembled by slipping the piece through for example the gap 20 as seen in FIG. 5. As mentioned the shell pieces are preferably of a plastics material that have some ability to yield or flex. This also allows for the last shell piece to be maneuvered through the gap 20 and for the free edges of that last shell piece to overlap the lips of the respective adjacent shell pieces.

The invention claimed is:

1. A breakable shell defining an enclosure within which a toy is contained, the breakable shell comprising of a plurality of plastic shell pieces able to self-retain together to define the enclosure yet when dropped from a sufficient height on a solid surface the shell pieces all disconnect from each other thereby revealing the toy, wherein each shell piece is in an underlapping condition with two adjacent shell pieces at two opposed peripheral regions of the shell piece, and in an overlapping condition with another two adjacent shell pieces at two other opposed peripheral regions of the shell piece, and wherein each shell piece is resiliently flexible, and when the shell is in its assembled condition each of the shell pieces is outwardly flexed and is in a more flexed state compared to when the shell is in the broken condition.

2. A breakable shell as claimed in claim 1 wherein the peripheral shape of the shell is spherical.

3. A breakable shell as claimed in claim 1 wherein each shell piece is of a weight that is within a 10% range of each other.

4. A breakable shell as claimed in claim 1 wherein each shell piece is of a weight that is within a 2% range of each other.

5. A breakable shell as claimed in claim 1 wherein each shell piece is arcuate and elongate and has two end peripheral regions and two side peripheral regions extending between the two end peripheral regions.

6. A breakable shell as claimed in claim 5 wherein each end peripheral region of a shell piece is in overlap with a side peripheral region of a respective adjacent shell piece.

7. A breakable shell as claimed in claim 1 wherein each shell piece comprises of a shell piece body that presents a shell surface, the shell surface of each shell piece defining a part of the peripheral shape of the shell and being identical to the shell surfaces of all the other shell pieces so that when the shell pieces are connected together the shell surfaces are in a tessellated condition.

8. A breakable shell as claimed in claim 7 wherein the shell piece body substrates the shell surface save for a lip at each of two opposed peripheral regions of the shell piece body that projects beyond the shell surface.

9. A breakable shell as claimed in claim 8 wherein said lips of each shell piece underlap an adjacent shell piece.

10. A breakable shell as claimed in claim 7 wherein there are 8 tri-points defined by the periphery of shell surfaces of the shell pieces.

11. A breakable shell as claimed in claim 10 wherein the shell is spherical and wherein each tripoint is of a tripoint pair that are diametrically opposed each other.

12. A breakable shell as claimed in claim 10 wherein a squeezing of the shell at a pair of tripoints results in a breaking of the shell at a lower pressure than when the shell is squeezed elsewhere.

13. A breakable shell as claimed in claim 1 comprising of 6 shell pieces.

14. A breakable shell as claimed in claim 1 consisting of 6 shell pieces.

15. A breakable shell as claimed in claim 1 that when dropped on a solid flat surface from at least 1 meter high above the surface the shell will break apart.

16. A breakable shell as claimed in claim 1 that when dropped on a solid flat surface from less than 20 cm the shell will not break apart.

17. A method of packaging a toy by providing the toy inside of the breakable shell as claimed in claim 1.

18. A breakable shell as claimed in claim 1, wherein the outwardly flexed state is caused by each shell piece being in the underlapping and overlapping relationships with the adjacent shell pieces.

19. A breakable shell defining an enclosure within which an item can be contained, the breakable shell comprising of a plurality of plastic shell pieces able to self-connect together to define the enclosure yet when dropped on a solid surface the shell pieces all disconnect from each other, wherein each shell piece is in an underlapping condition with two adjacent shell pieces at two opposed peripheral regions of the shell piece, and in an overlapping condition with another two adjacent shell pieces at two other opposed peripheral regions of the shell piece, and wherein each shell piece is resiliently flexible, and when the shell is in its assembled condition each of the shell pieces is outwardly flexed and is in a more flexed state compared to when the shell is in the broken condition.

20. A breakable shell as claimed in claim 19, wherein the outwardly flexed state is caused by each shell piece being in the underlapping and overlapping relationships with the adjacent shell pieces.

21. A toy contained inside an enclosure of a breakable shell comprising of a plurality of plastic shell pieces self-connected together in a releasable manner to define the enclosure, wherein when dropped on flat solid surface from at least 1 m high, the shell pieces all separate from each other thereby revealing the toy, wherein each shell piece is in an underlapping condition with two adjacent shell pieces at two opposed peripheral regions of the shell piece, and in an overlapping condition with another two adjacent shell pieces at two other opposed peripheral regions of the shell piece, and wherein each shell piece is resiliently flexible, and when the shell is in its assembled condition each of the shell pieces is outwardly flexed and is in a more flexed state compared to when the shell is in the broken condition.

22. A toy contained inside an enclosure of a breakable shell as claimed in claim 21, wherein the outwardly flexed state is caused by each shell piece being in the underlapping and overlapping relationships with the adjacent shell pieces.

* * * * *